US010883712B2

(12) United States Patent
Chen et al.

(10) Patent No.: US 10,883,712 B2
(45) Date of Patent: Jan. 5, 2021

(54) LUMINAIRE

(71) Applicant: SIGNIFY HOLDING B.V., Eindhoven (NL)

(72) Inventors: Feihong Chen, Shanghai (CN); Xia Wang, Shanghai (CN)

(73) Assignee: SIGNIFY HOLDING B.V., Eindhoven (NL)

( * ) Notice: Subject to any disclaimer, the term of this patent is extended or adjusted under 35 U.S.C. 154(b) by 11 days.

(21) Appl. No.: 16/462,928

(22) PCT Filed: Nov. 27, 2017

(86) PCT No.: PCT/EP2017/080519
§ 371 (c)(1),
(2) Date: May 21, 2019

(87) PCT Pub. No.: WO2018/099860
PCT Pub. Date: Jun. 7, 2018

(65) Prior Publication Data

US 2019/0309937 A1 Oct. 10, 2019

(30) Foreign Application Priority Data

Dec. 2, 2016 (WO) ..... PCT/CN2016/108348
Mar. 6, 2017 (EP) ..... 17159410

(51) Int. Cl.
*F21V 29/89* (2015.01)
*F21V 29/503* (2015.01)
(Continued)

(52) U.S. Cl.
CPC ..... *F21V 29/89* (2015.01); *F21S 8/061* (2013.01); *F21V 29/503* (2015.01); *F21V 29/75* (2015.01);
(Continued)

(58) Field of Classification Search
CPC ..... F21V 29/75; F21V 29/773
See application file for complete search history.

(56) References Cited

U.S. PATENT DOCUMENTS 6,466,444 B2 * 10/2002 Cheung ..... F28F 3/02 165/185
8,403,541 B1 * 3/2013 Rashidi ..... F21S 8/026 257/712
(Continued)

FOREIGN PATENT DOCUMENTS

CN 101451698 A 6/2009
CN 102425772 A 4/2012
(Continued)

*Primary Examiner* — Georgia Y Epps
*Assistant Examiner* — Jacob R Stern
(74) *Attorney, Agent, or Firm* — Daniel J. Piotrowski

(57) ABSTRACT

A luminaire with a heat sink (1), which heat sink is formed by one integral piece of cold forged aluminum, comprising an essentially flat base portion (2), having a base surface with a center (2*a*) and an outer periphery (2*b*) and a set of heat dissipating fins (3, 4) extending from a first side of the base surface, in a direction normal to the base surface. The set includes at least one radial heat dissipating fin (3) having a cross section in a plane parallel to the base surface which cross section extends substantially in a radial direction from the center (2*a*) towards the outer periphery (2*b*), and at least one peripheral heat dissipating fin (4) having a cross section in a plane parallel to the base surface which cross section includes a portion extending in a direction parallel to the outer periphery (2*b*), wherein the peripheral heat dissipating fins (4) are arranged radially outside the radial heat dissipating fins (3).

13 Claims, 3 Drawing Sheets

(51) Int. Cl.

| | |
|---|---|
| ***F21V 29/75*** | (2015.01) |
| ***F21V 29/77*** | (2015.01) |
| ***F21S 8/06*** | (2006.01) |
| *F21V 29/83* | (2015.01) |
| *F21Y 115/10* | (2016.01) |
| *F21V 29/507* | (2015.01) |

(52) U.S. Cl.
CPC ..... *F21V 29/773* (2015.01); *F21V 29/507* (2015.01); *F21V 29/83* (2015.01); *F21Y 2115/10* (2016.08)

(56) References Cited

U.S. PATENT DOCUMENTS

| | | | | |
|---|---|---|---|---|
| 8,585,250 | B1 | 11/2013 | Kim et al. | |
| 2011/0254421 | A1 | 10/2011 | Thomas | |
| 2012/0155080 | A1 | 6/2012 | Schupple et al. | |
| 2013/0233511 | A1* | 9/2013 | Swedberg | F21V 27/02 165/80.2 |
| 2014/0268730 | A1* | 9/2014 | Lui | F21V 23/008 362/227 |
| 2017/0307181 | A1* | 10/2017 | Engle | F21V 17/002 |

FOREIGN PATENT DOCUMENTS

| | | | |
|---|---|---|---|
| CN | 202469538 | U | 10/2012 |
| CN | 103047563 | A | 4/2013 |
| CN | 203036273 | U | 7/2013 |
| CN | 203258614 | U | 10/2013 |
| CN | 204127805 | U | 1/2015 |
| CN | 204664913 | U | 9/2015 |
| CN | 204665071 | U | 9/2015 |
| CN | 204986558 | U | 1/2016 |
| CN | 205101940 | U | 3/2016 |
| CN | 105546415 | A | 5/2016 |
| CN | 205535680 | U | 8/2016 |
| GB | 2507185 | A | 4/2014 |

* cited by examiner

LUMINAIRE

CROSS-REFERENCE TO PRIOR APPLICATIONS

This application is the U.S. National Phase application under 35 U.S.C. § 371 of International Application No. PCT/EP2017/080519, filed on Nov. 27, 2017 which claims the benefit of Chinese Patent Application No. PCT/CN2016/108348, filed on Dec. 2, 2016 and European Patent Application No. 17159410.4, filed on Mar. 6, 2017. These applications are hereby incorporated by reference herein.

FIELD OF THE INVENTION

The present invention relates to a luminaire, in particular a solid state luminaire with a low weight heat sink.

BACKGROUND OF THE INVENTION

Lighting devices—or luminaires—employing solid state light sources, such as light emitting diodes (LEDs), require some kind of heat sink or radiator, in order to dissipate the heat generated by the light sources. Conventionally, such heat sinks are manufactured by die casting or aluminum extrusion.

Die casting has the drawback of not allowing the formation of long, thin fins. When the fins are made longer than e.g. 50 mm, they will typically have to be made thicker to be sufficiently strong. This leads not only to a waste of material, but also to increased weight which in turn has additional cost drawbacks.

Aluminum extrusion, on the other hand, is severely limited in geometry, as the cross section of any extruded object will be constant. Therefore, an extruded heat sink will require additional parts, such as cover and bracket, increasing product cost while at the same time decreasing heat dissipation.

SUMMARY OF THE INVENTION

It is an object of the present invention to provide a heat sink which does not suffer from the drawback mentioned above.

According to a first aspect of the invention, this and other objects is achieved by a heat sink for a lighting device, which heat sink is formed by one integral piece of cold forged aluminum, the piece comprising an essentially flat base portion, having a base surface with a center and an outer periphery, a set of heat dissipating fins extending from a first side of the base surface, in a direction normal to the base surface, the set including at least one radial heat dissipating fin having a cross section in a plane parallel to the base surface which cross section extends substantially in a radial direction from the center towards the outer periphery, at least one peripheral heat dissipating fin having a cross section in a plane parallel to the base surface which cross section includes a portion extending in a direction parallel to the outer periphery, wherein the peripheral heat dissipating fins are arranged radially outside the radial heat dissipating fins.

According to a second aspect of the invention, this and other objects is achieved by a method for manufacturing a heat sink comprising cold forging one integral piece of aluminum, the piece comprising an essentially flat base portion, having a base surface with a center and an outer periphery, a set of heat dissipating fins extending from a first side of the base surface, in a direction normal to the base surface, the set including at least one radial heat dissipating fin having a cross section in a plane parallel to the base surface which cross section extends substantially in a radial direction from the center towards the outer periphery, at least one peripheral heat dissipating fin having a cross section in a plane parallel to the base surface which cross section includes a portion extending in a direction parallel to the outer periphery, wherein the peripheral heat dissipating fins are arranged radially outside the radial heat dissipating fins.

By making a heat sink of cold forged aluminum, the weight of the heat sink can be kept lower for a given heat dissipation performance. As an example, in order to dissipate heat from a 200 W lighting device, conventionally a 2.3 kg Al extrusion heat sink, or a 2.5 kg die cast heat sink is required. However, the inventors have found that a cold forged Al heat sink only needs to weigh 1.6 kg.

As mentioned above, a challenge with the cold forging process is that long, thin heat dissipating fins will provide less structural strength and stability. For this reason, the inventors have developed a heat sink with a very specific design of the heat dissipating fins. The combination of "radial" fins and "peripheral" fins provide an increased ratio between structural strength and heat dissipation. It should be noted that the cross section of a "radial" fin not necessarily extends all the way to the center. Also, the cross section of a "peripheral" fin is not necessarily located along the periphery but may be closer to the center.

The peripheral heat dissipating fins may have a center portion extending in a direction parallel to the periphery and at least one transverse portion, extending from the center portion substantially in a radial direction. Examples of such cross sections include a T-section, an L-section, a C-section and an E-section. The opening side of the section can face into or out from the center, depending on the desired appearance.

A first subset of peripheral heat dissipating fins may be arranged substantially symmetrically along the outer periphery. With such arrangement, the first subset will form a sort of ridge around the periphery. Adjacent fins may be separated by a gap, so as to form a broken ridge allowing passage of air.

In one specific embodiment, a first subset of peripheral heat dissipating fins are arranged at a first radial distance from said center and with gaps formed between adjacent fins, and a second subset of peripheral heat dissipating fins are arranged in said gaps at a second radial distance from said center, said second radial distance being smaller than said first radial distance. With this design, a "labyrinth" will be formed between the two subsets of peripheral fins, allowing air to flow through the heat sink. At the same time, the overlapping arrangement of the two subsets will provide a visual impression of a closed ridge around the periphery.

A heat sink according to the first aspect may advantageously be incorporated in a luminaire further comprising a set of solid state light emitting devices supported by the base portion on a second side opposite the first side with the heat dissipating fins, the solid state light emitting devices being in thermal connection with the heat sink, and driver circuitry connected to drive the light emitting devices.

The driver circuitry is arranged on one side of the center and on the same side of the base portion as the heat dissipating fins, wherein the radial heat dissipating fins are arranged so as to counter-balance a weight of the driver circuitry, such that the luminaire will be balanced around the center.

Luminaires are conventionally designed symmetrical, in order to hang straight from e.g. a cord. However, there are often advantages with arranging the driver circuitry off-center, e.g. to reduce adding height (thickness) to the luminaire. In such cases, a counter-weight is often added, in order to maintain a weight symmetry. The present inventors have realized that such a counter-weight can be avoided, by arranging the heat dissipating fins of the heat sink in an asymmetrical manner. As a result, the total weight of the luminaire can be reduced while maintaining weight symmetry.

The luminaire may further comprise a cover arranged to cover distal ends of the heat dissipating fins (radial and peripheral). The cover may comprise a plurality of openings separated by ribs, the ribs including at least one rib having a V-shaped cross section, with an open end of the V facing the heat dissipating fins, and at least one rib having a U-shaped cross section, with an open end of the U facing the heat dissipating fins. Such a combination of differently formed ribs provides for an advantageous combination of structural strength and light weight, while still allowing air to pass through the cover.

The cover may further comprise shielding portions extending from at least some of the ribs to at least partly close the openings. Such shielding portions, which typically extend in a plane parallel to the base portion, may serve to completely cover an opening in a direction normal to the base portion, while still allowing air to pass in a direction parallel to the base portion.

For a given thickness (height) of the cover, the U-shaped cross section may be wider than the V-shaped cross section. This further increases structural strength, without increasing the thickness of the cover.

The cover may comprise a central threaded mounting opening, e.g. allowing a screw mounting of a hook or rod for supporting/suspending the luminaire. Alternatively, the cover may comprise a mechanical mounting element, e.g. a bracket, arranged inside a central opening in the cover. This mounting element may have a threaded opening, again allowing a screw mounting of a hook or rod for supporting the luminaire.

The luminaire may further comprise an electric cable extending through the opening, said cable being electrically connected to the driver circuitry.

It is noted that the invention relates to all possible combinations of features recited in the claims.

BRIEF DESCRIPTION OF THE DRAWINGS

This and other aspects of the present invention will now be described in more detail, with reference to the appended drawings showing embodiment(s) of the invention.

DETAILED DESCRIPTION

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person.

Figure 1:
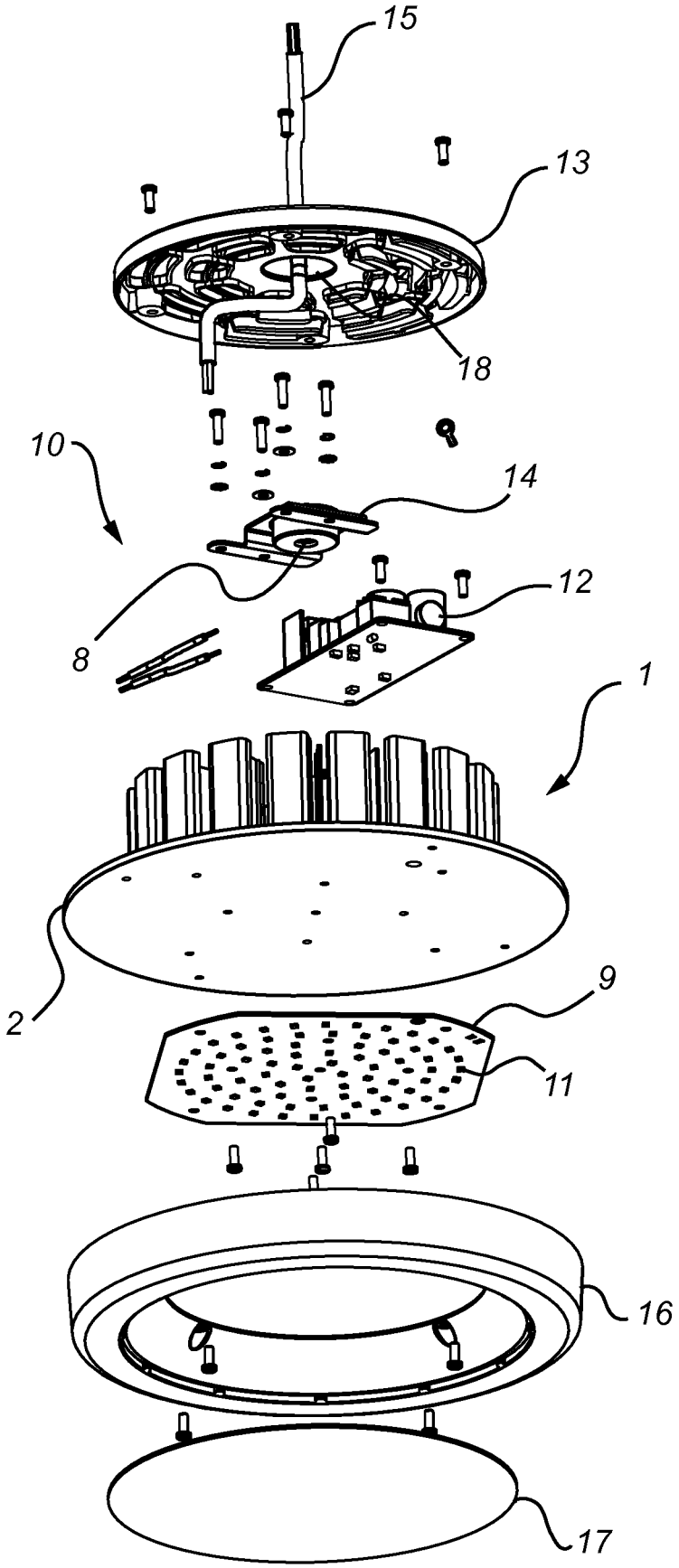
FIG. 1 is an exploded view of a luminaire including a heat sink according to an embodiment of the present invention.

FIG. 1 shows an exploded view of the most relevant parts of a luminaire 10. The luminaire includes a set of light emitting devices, here solid state light emitting devices such as LEDs 11. The LEDs 11 are here mounted on a circuit board 9, providing electrical connection of the LEDs 11. The circuit board 9 is in turn mounted on a heat sink 1, designed to dissipate heat generated by the LEDs 11. The heat sink 1 will be discussed in more detail with reference to FIG. 2.

The luminaire further comprises driver circuitry 12 connected to the LEDs 11 (here via the conducting paths on the circuit board 9). The drive circuitry 12 is configured to drive the LEDs 11. In the illustrated case, the driver circuitry 12 is mounted on the opposite side of the heat sink with respect to the LEDs 11, and also attached to the heat sink 1. This design has the advantage that also heat generated by the driver circuitry can be dissipated by the heat sink 1. However, numerous other arrangements of the driver circuitry are possible.

A cover 13 is arranged on the heat sink as a lid arranged to cover distal ends of the heat dissipating fins. In the illustrated embodiment, the LEDs 11 are arranged on the bottom side of the luminaire, and the cover 13 is arranged on the top. This orientation may be different in other applications. A bracket 14 is mounted to the heat sink 1, and configured to enable suspension of the luminaire 10 by means of a threaded opening 8. The cover 13 is provided with an opening 18 aligned with the opening 8 in the mounting bracket 14. Alternatively, the bracket 14 may be mounted directly to the cover 13. An electrical cable 15 passes through the opening 18, and is electrically connected to the driver circuitry 12 by suitable mans (not shown).

On the other side of the luminaire 10, i.e. facing downwards in the illustrated configuration, is arranged a diffusor 17, mounted in an annular rim 16. The diffusor 17 is preferably releasably mounted, so that the LEDs 11 can be accessed to allow replacement.

Figure 2:
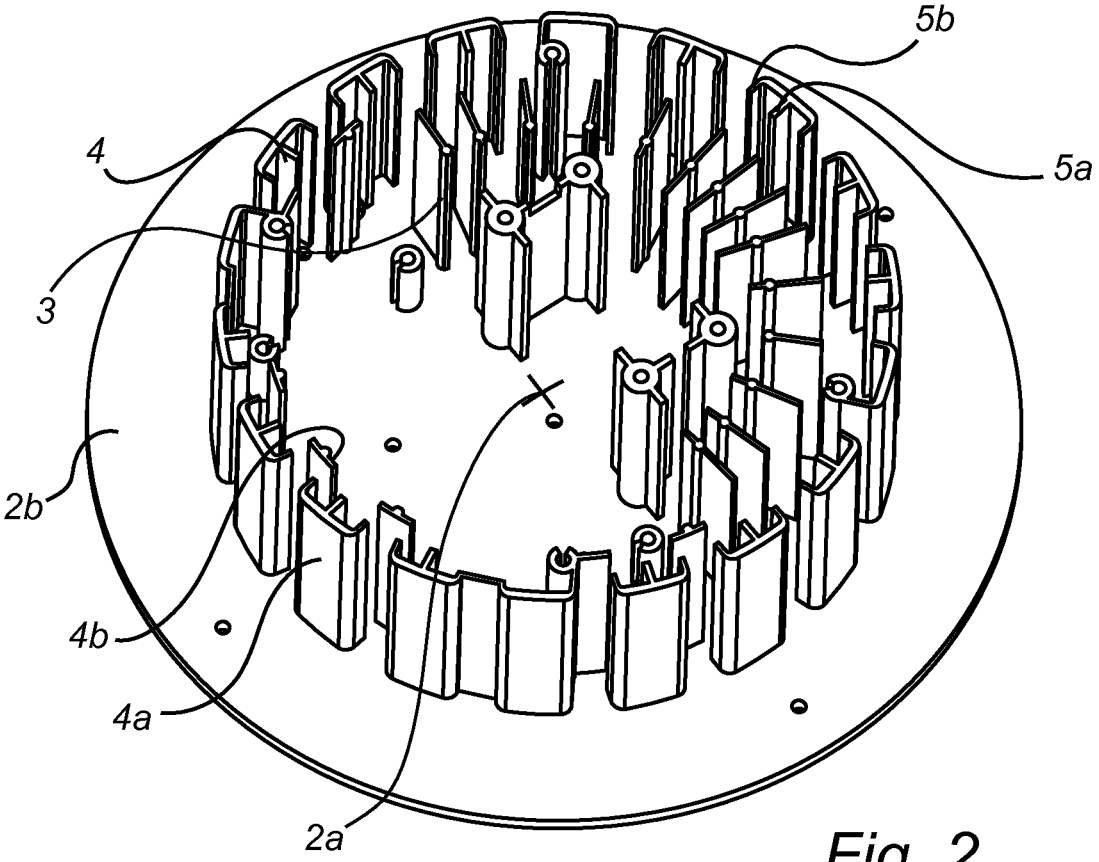
FIG. 2 is a perspective view of the heat sink in FIG. 1.

The heat sink 1 is shown in more detail in FIG. 2, where it is viewed from above with respect to the view in FIG. 1. The view in FIG. 2 reveals a set of heat dissipating fins 3, 4 extending from the surface of the base portion 2.

The fins include radial fins 3 having a cross section (in a plane parallel to the surface of the base portion) which extends essentially in a radial direction from the center 2*a* of the base portion towards the periphery 2*b* of the base portion.

The fins also include peripheral fins 4 having a cross section (again in a plane parallel to the surface of the base portion) which includes a portion extending in a direction parallel to the periphery 2*b* of the base surface. In the illustrated case, the cross section of the peripheral heat dissipating fins has a center portion 5*a* extending in a direction parallel to the periphery 2*b* and at least one transverse portion 5*b* extending from the center portion substantially in a radial direction. In the case of one single transverse portion 5*b*, the cross section can be a T-section or an L-section. In the case of two transverse sections 5*b*, the cross section can be a C-section. In the case of three transverse sections 5*b*, the cross section can be an E-section.

In the illustrated case, some peripheral fins 4 have a C-section, with a center portion 5*a* and two end portions 5*b*, while some have an E-section, with a center portion 5*a* and three transverse portions 5*b*.

In FIG. 2, a first subset of peripheral heat 4*a* dissipating fins are arranged substantially symmetrically along the outer periphery 2*b*. The fins are separated by gaps, so as to firm a rim or ridge with openings. Further, a second subset of peripheral heat dissipating fins 4*b* are arranged inside the gaps, i.e. between the fins in the first subset and closer to the center 2*a*.

In the illustrated embodiment, the driver circuitry 12 is intended to be mounted on the left side of the heat sink in FIG. 2. In order to counter balance the weight of the driver circuitry 12, and to ensure a balanced suspension (e.g. from a cord or wire), the radial heat dissipating fins 3 are asymmetrically arranged around the center 2*a* (i.e. here arranged primarily to the right in FIG. 2).

Figure 3:
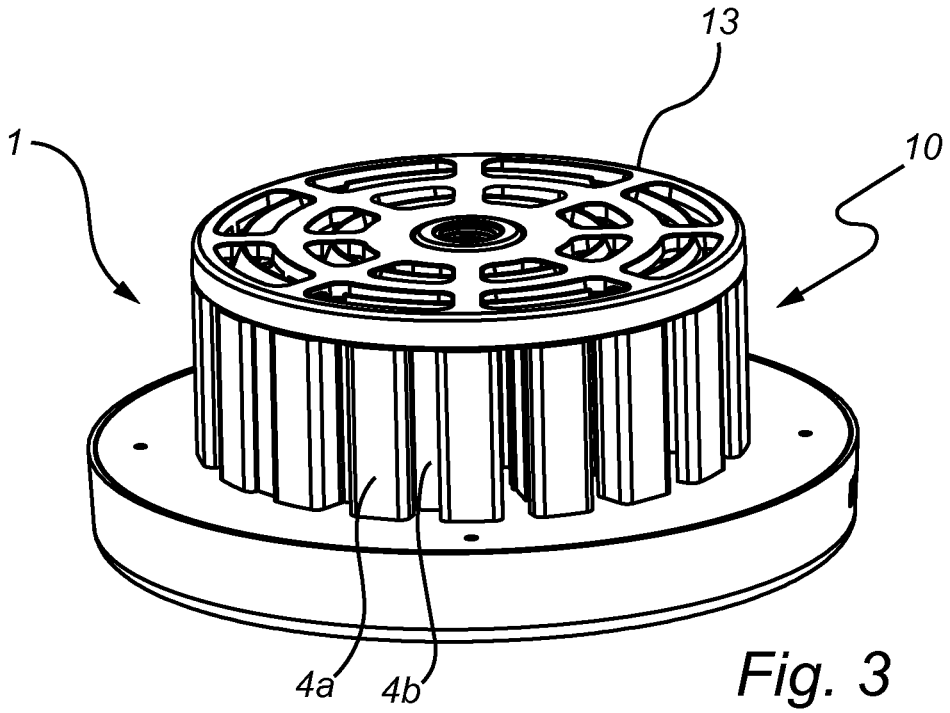
FIG. 3 is a perspective view of the luminaire in FIG. 1.

The assembled luminaire 10 is shown in FIG. 3. As is clear from FIG. 3, the two subsets of peripheral heat dissipating fins 4*a*, 4*b* enclose the entire outer periphery 2*b*, and give a visual impression of a closed wall. However, as is clear from FIG. 2, the arrangement of the peripheral fins allow passage of air through the heat sink 1, thereby allowing satisfactory heat spreading.

Figure 4:
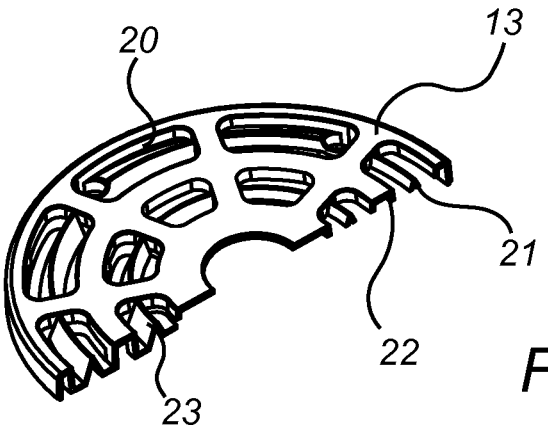
FIG. 4 is a partial perspective view of the cover in FIG. 1.

The cover 13 of the luminaire is shown in section in FIG. 4. The cover 13 comprises a plurality of openings 20 separated by ribs 21, 22, the ribs including at least one rib 21 having a V-shaped cross section, with an open end of the V facing the heat dissipating fins, and at least one rib 22 having a U-shaped cross section, with an open end of the U facing the heat dissipating fins. Some of the ribs 21, 22, here the V-shaped ribs 21, are provided with wing-like shielding portions 23 that extend from the open end of the V in a plane parallel to the cover (and to the base portion). These shielding portions serve to further close some of the openings 20, at least in a direction normal to the plane of the cover (and to the base portion). Air is still allowed to pass in a direction parallel to the plane of the cover.

The person skilled in the art realizes that the present invention by no means is limited to the preferred embodiments described above. On the contrary, many modifications and variations are possible within the scope of the appended claims. For example, the exact design of the heat dissipating fins 3, 4 and the ribs 21, 22 may be different than that disclosed herein. Further, the luminaire may include additional components than this mentioned above.

The invention claimed is:

1. A luminaire comprising:

a heat sink formed by one integral piece of cold forged aluminum, said piece comprising:

an essentially flat base portion, having a base surface with a center and an outer periphery, a set of heat dissipating fins extending from a first side of said base surface, in a direction normal to said base surface, said set including:

at least one radial heat dissipating fin having a cross section in a plane parallel to said base surface which cross section extends substantially in a radial direction from said center towards said outer periphery, and at least one peripheral heat dissipating fin having a cross section in a plane parallel to said base surface which cross section includes a portion extending in a direction parallel to said outer periphery, wherein the peripheral heat dissipating fins are arranged radially outside the radial heat dissipating fins;

a set of solid state light emitting devices supported by said base portion on a second side opposite said first side with the heat dissipating fins, said solid state light emitting devices being in thermal connection with said heat sink, and driver circuitry connected to drive the light emitting devices;

wherein said driver circuitry being arranged on one side of the center and on the same side of the base portion as the heat dissipating fins, wherein said driver circuitry is encircled by the at least one peripheral heat dissipating fin and the at least one peripheral heat dissipating fin of said heat sink, wherein said radial heat dissipating fins are arranged so as to counter-balance a weight of said driver circuitry, such that said luminaire will be balanced around said center.

2. The luminaire according to claim 1, wherein the cross section of said at least one peripheral heat dissipating fin has a center portion extending in a direction parallel to said periphery and at least one transverse portion, extending from the center portion substantially in a radial direction.

3. The luminaire according to claim 2, wherein the cross section of said at least one peripheral heat dissipating fin is one of a T-section, an L-section, a C-section and an E-section.

4. The luminaire according to claim 1, wherein the radial heat dissipating fins are asymmetrically arranged on the heat sink.

5. The luminaire according to claim 1, wherein a first subset of peripheral heat dissipating fins are arranged substantially symmetrically along the outer periphery.

6. The luminaire according to claim 1, wherein a first subset of peripheral heat dissipating fins are arranged at a first radial distance from said center and with gaps formed between adjacent fins, and a second subset of peripheral heat dissipating fins are arranged in said gaps at a second radial distance from said center, said second radial distance being smaller than said first radial distance.

7. A luminaire according to claim 1, further comprising a cover arranged to cover distal ends of the heat dissipating fins, said cover comprising a plurality of openings separated by ribs, said ribs including at least one rib having a V-shaped cross section, with an open end of the V facing the heat dissipating fins, and at least one rib having a U-shaped cross section, with an open end of the U facing the heat dissipating fins and wherein the said driver circuitry is fully enclosed by the at least one peripheral heat dissipating fin and the at least one peripheral heat dissipating fin of said one heat sink and said cover.

8. The luminaire according to claim 7, further comprising shielding portions extending from at least some of the ribs to at least partly close said openings.

9. The luminaire according to claim 7, wherein the U-shaped cross section is wider than the V-shaped cross section.

10. The luminaire according to claim 7, said cover comprising a central threaded mounting opening.

11. The luminaire according to claim 7, further comprising a mechanical mounting element arranged inside a central opening in the cover.

12. The luminaire according to claim 10, further comprising an electric cable extending through the opening, said cable being electrically connected to the driver circuitry.

13. A luminaire comprising:

a heat sink formed by one integral piece of cold forged aluminum, said piece comprising:

an essentially flat base portion, having a base surface with a center and an outer periphery, a set of heat dissipating fins extending from a first side of said base surface, in a direction normal to said base surface, a cover with openings arranged to cover distal ends of the heat dissipating fins;

a set of solid state light emitting devices supported by said base portion on a second side opposite said first side with the heat dissipating fins, said solid state light emitting devices being in thermal connection with said heat sink, and driver circuitry connected to drive the light emitting devices and to the first side with the heat dissipating fins of the heat sink;

wherein the driver circuitry is arranged on one side of the center and on the same side of the base portion as the heat dissipating fins, and wherein the said driver circuitry is fully enclosed by the dissipating fins of said one heat sink and said cover, wherein said radial heat dissipating fins are arranged so as to counter-balance a weight of said driver circuitry, such that said luminaire will be balanced around said center.

* * * * *